US005232100A

United States Patent [19]

Lewis

[11] Patent Number: 5,232,100

[45] Date of Patent: Aug. 3, 1993

[54] METHOD AND APPARATUS FOR DETECTING AND ELIMINATING CIGARETTES WITH LOOSE FILTER TIPS DURING CIGARETTE MANUFACTURING

[75] Inventor: Robert T. Lewis, Macon, Ga.

[73] Assignee: Brown & Williamson Tobacco Corporation, Louisville, Ky.

[21] Appl. No.: 869,583

[22] Filed: Apr. 16, 1992

[51] Int. Cl.[5] ..... B07C 5/00

[52] U.S. Cl. ..... 209/537; 73/49.8

[58] Field of Search ..... 209/535, 536, 537; 73/37, 49.8

[56] References Cited

U.S. PATENT DOCUMENTS 3,543,927 12/1970 Pinkham et al. ..... 209/537

*Primary Examiner*—Robert P. Olszewski
*Assistant Examiner*—Kenneth Noland
*Attorney, Agent, or Firm*—Charles I. Sherman; Charles G. Lamb

[57] ABSTRACT

An apparatus and method for detecting and eliminating cigarettes having loose filter tips whereby the tobacco rod end of a filter cigarette is held in place and a pre-set separating force is exerted on the filter to see if the filter is secured properly to the tobacco rod; and, if not, the filter and tobacco rod are rejected. A rotatable, splitable drum assembly is provided with a first and second vacuum source and the rotatable, splitable drum assembly is splitable into first and second segments. The drum is provided with longitudinally extending grooves therein which continually extend onto the first and second segments. Each groove is sized to receive a filter tip cigarette therein and each groove is also in vacuum communication with the first and second vacuum source. The first segment of the drum is coupled with the tobacco rod end of a filter tip cigarette by the first vacuum and the second segment of the drum is coupled with the filter of the filter tip cigarette by the second vacuum.

28 Claims, 7 Drawing Sheets

METHOD AND APPARATUS FOR DETECTING AND ELIMINATING CIGARETTES WITH LOOSE FILTER TIPS DURING CIGARETTE MANUFACTURING

BACKGROUND OF THE INVENTION

The present invention relates to a loose filter detecting machine and method for detecting loose filters on cigarettes and rejecting the cigarette product having the loose filter.

In the manufacturing of cigarettes including filter tips on the mouth end thereof, the filters are joined by tipping paper to a tobacco rod, which has been previously wrapped in cigarette paper. The tipping paper is generally sized so that it will circumscribe the entire filter and a portion of the paper-wrapped tobacco rod, thereby holding the filter to the tobacco rod. However, in the manufacture of filter cigarettes, problems are encountered with the attaching of the filters to the tobacco rod. If the tipping paper does not securely hold the filter tip to the tobacco rod portion of the cigarette product, the filter may become detached during packaging of the product, in the shipping of the product, or when used by the consumer.

There have been a number of means suggested to test the integrity of the attachment of the filter to the tobacco rod. However, the most common means are visually observing the product prior to packaging to determine whether or not the filters are securely fastened to the cigarettes or by grabbing samples and then physical pulling some of the filters to see whether or not they are securely fastened.

Moreover, U.S. Pat. No. 3,233,613, teaches a system for reclaiming defective cigarette assemblies comprising elongated or rotary blades for cutting groups of cigarettes carried between movable belts. U. S. Pat. No. 3,327,444, teaches a system for testing the integrity of and resistance to flow through hollow articles such as cigarettes including the use of rolling drums which are provided with a plurality of axially extending segments in the form of recesses in which successive filter cigarette are carried and/or transferred thereby in a pneumatic testing process. U.S. Pat. No. 3,404,688 teaches another system for disassembling filter and cigarette assemblies including, for example, cutting blades. U.S. Pat. No. 3,468,416, teaches a pneumatic method and apparatus for testing cigarettes to detect loose ends and missing filter tips wherein stationary nozzles are positioned at the ends of the cigarettes moving on a conveyor at constant speed, and each nozzle directs air towards the adjacent end of the cigarette, one air jet flowing at a relatively high pressure and an adjacent jet flowing at a lower pressure, the pressure of the lower pressure air jet being indicative of the acceptability or non-acceptability of the end texture fabrication of the cigarette. U.S. Pat. No. 3,677,068, teaches a pneumatic testing concept using a rotatably mounted drum provided with a plurality of axially extending troughs having openings disposed around the circumferential surface of the drum wherein cigarettes are fed radially into the openings as the drum rotates and the troughs are of such a depth that the cigarettes do not project above the drum surface; consequently, as the drum rotates in contact with a movable belt extending over an arcuate portion of its circumference, the troughs are closed while covered by the belt and while the troughs are so closed, air under pressure is injected into the closed troughs and a vacuum source is supplied by way of an axial bore in a piston pressed against the cigarettes' insurface to the respective cigarette, so that the resulting air displacement, if any, is monitored and, where it exceeds a predetermined amount, indicating that the cigarette wrapping paper is faulty, the cigarette is rejected.

SUMMARY OF THE INVENTION

An object of the present invention is to provide a method and means for determining the integrity of a cigarette composed of a filter which is attached to the mouth end of a tobacco rod, whereby the tobacco rod end of the filter cigarette is held and a preset separating force is exerted on the filter to see if the filter is secured properly to the tobacco rod and, if not, the filter and tobacco rod are rejected. In the alternative, opposing forces can be exerted on both the filter and tobacco rod ends.

Another object of the present invention is to provide a mechanical means for determining the integrity of the attachment of the filter to a tobacco rod.

Even a further object of the present invention is to provide a rotatable splitable drum assembly, with two vacuum means, one vacuum means being for holding the tobacco rod portion of the cigarette to the rotating drum assembly and the other vacuum means being to hold the filter to the rotatable drum assembly, so that, as the drum assembly splits, upon rotation the filters detach from any poorly assembled cigarettes.

More particularly, the present invention provides an apparatus for eliminating cigarettes with loose filter tips, comprising; means providing a first and a second vacuum; a rotatable splitable drum assembly being rotatably splitable into first and second segments, said drum having longitudinally extending grooves therein continually extending onto said first and second segments, each groove being sized to receive a filter tip cigarette therein, each groove being in vacuum communication with said first and second vacuum means, said first vacuum means being in vacuum communication with said first segment and said second vacuum means being in vacuum communication with said second segment; means to transfer filter tip cigarettes each having a filter and a tobacco rod end to said grooves in said rotatable drum assembly; and, means to remove said cigarettes and pieces thereof from said rotatable splittable drum assembly.

Even more particularly, the present invention provides a method for determining whether the filter and tobacco rod of a filter tip cigarette are properly attached, comprising the steps of: transferring a filter tip cigarette having a filter rod and tobacco rod from a filter tip cigarette manufacturing station to a filter integrity testing station; applying a first vacuum to said filter rod and a second vacuum to said tobacco rod while said cigarette is at said loose filter testing station; pulling said cigarette from one or both ends by said first or/and second vacuum means under preselected vacuum conditions; and, rejecting said cigarette if said pulling causes said filter to separate from said tobacco rod or transferring said cigarette to a station for further processing if said pulling force does not cause said filter to separate from said tobacco rod.

Other objects of the present invention will become obvious upon reading of the detailed description of a preferred embodiment set forth hereinafter.

BRIEF DESCRIPTION OF THE DRAWINGS

A preferred embodiment according to this invention will now be described with reference to the accompanying drawings in which.

DETAILED DESCRIPTION OF THE DRAWINGS

Figure 1:
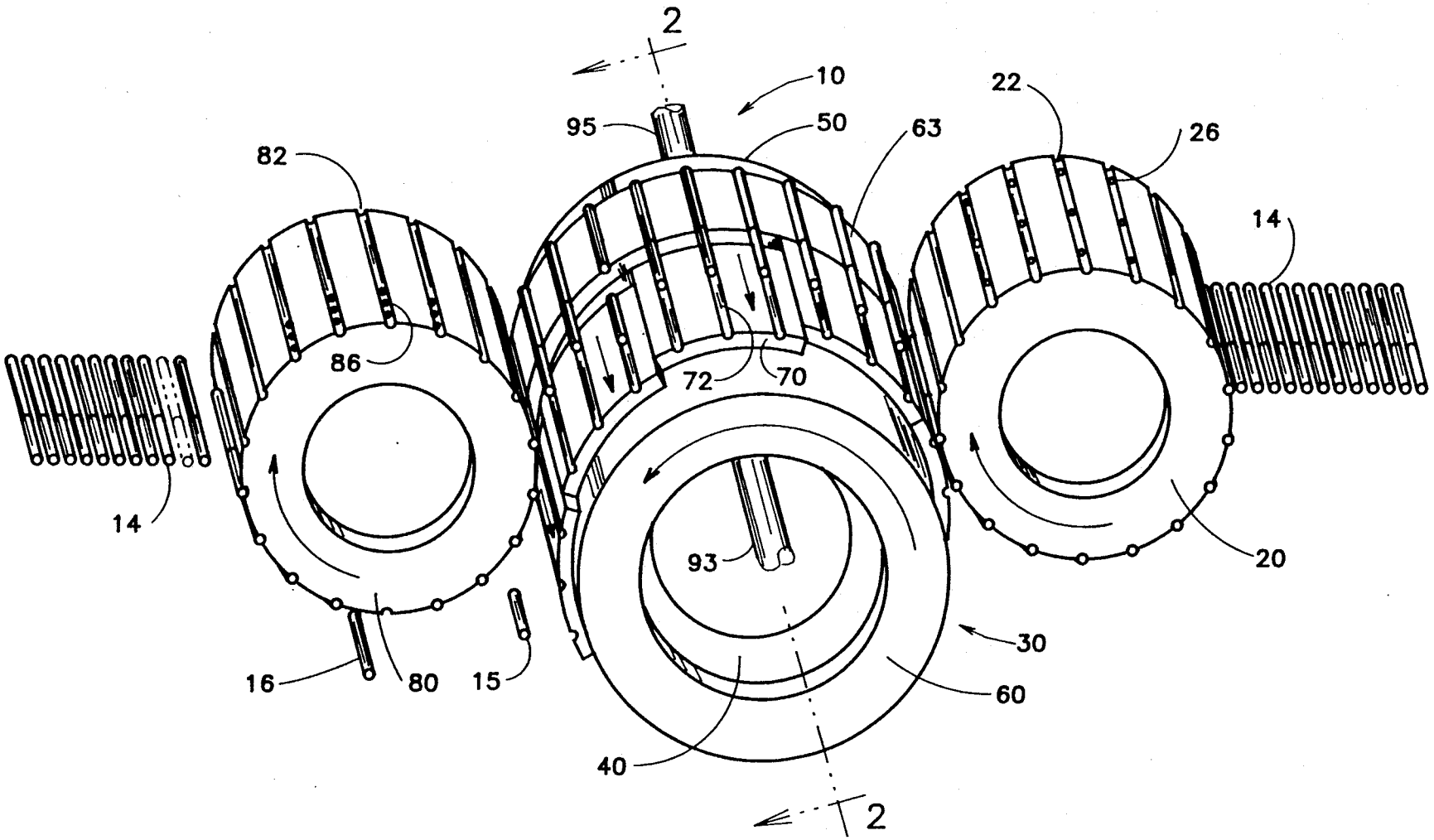
FIG. 1 is a perspective view of a preferred loose cigarette filter tip detecting station constructed in accordance with one embodiment of this invention.

Referring to the drawings in detail, and initially to FIG. 1 thereof, it will be seen that a loose filter detecting and eliminating station embodying the present invention, is generally identified by the reference numeral 10, as shown.

The apparatus 10 includes three rotatable drums, a transfer drum 20 which feeds filter cigarette units 14 having filters 15 and tobacco rods 16 to a splittable loose filter detecting drum 30, and a rotatable discharge or reject drum 80 which receives the cigarette product 14 and pieces thereof from the loose filter detecting drum 30. Each of the drums 20, 30, and 80 include grooves 22, 63, 82, respectively, therein which are sized to receive cigarette product 14 therein. The grooves 22, 63, 82 extend longitudinal to the axis of rotation of each of the drums 20, 30, 80, respectively. The drums 20 and 80 are rotatable in the same direction and the splitable drum 30 rotates in the opposite direction, wherein the drums 20 and 80 are in spaced relation to the drum 30, but the spacing is less than the diameter of a cigarette product 14 which is received within the grooves. Moreover, grooves 63 in the splitable drum 30 are in alignment with the grooves 22 and 82 in the drums 20 and 80 and the surface speed of the three drums are the same, so that, as the drums rotate thereby this enables safe transfer of cigarettes 14 between the drums 20, 30, and 80 using timed application of vacuum. Each of the drums 20, 30, and 80 are operable by drive means (not shown), so that all three of the drums turn at the same surface speed.

Figure 2:
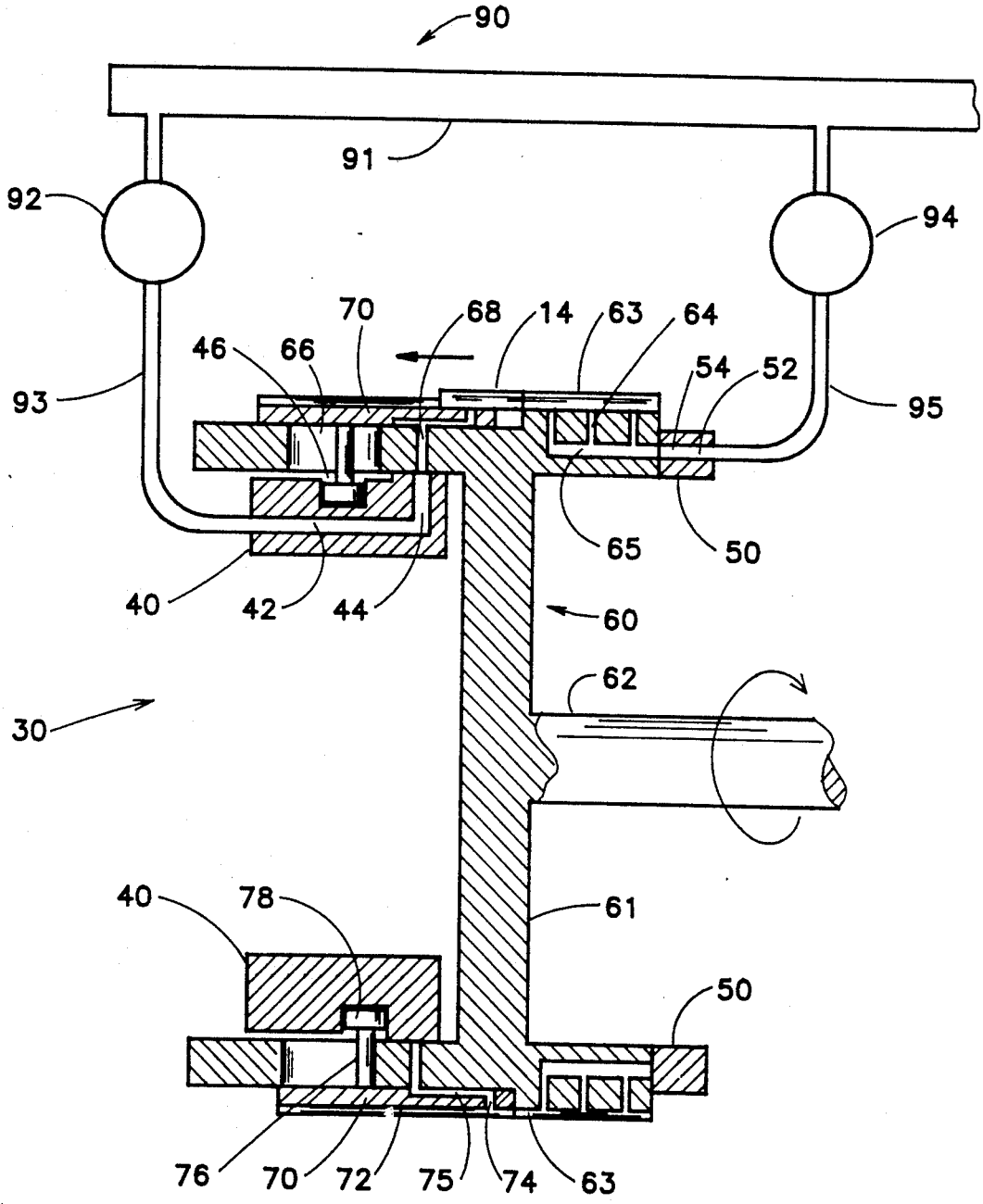
FIG. 2 is a cross-section view of a transversely splitable rotatable drum of FIG. 1, shown with selected portions cut away.

Splitable loose filter detecting drum assembly 30 is shown in cross-section in FIG. 2. Splittable loose filter detecting drum assembly 30 includes an inner vacuum ring 40, an outer vacuum ring 50, a circumferential rotatable splittable ring 60, and a plurality of plate sections 70. The purpose of splittable loose filter detecting drum assembly 30 is to hold a tobacco rod 16 of a filter tipped cigarette 14 in one of grooves 63 by a second vacuum in flow communication from a vacuum source (not shown) of vacuum apparatus 90 through vacuum source conduit 91, second vacuum regulator 94, second vacuum line 95, vacuum bore 52 and vacuum groove 54 of outer vacuum ring 50, and vacuum conduit 65 and groove apertures 64 in groove 63 and to hold the filter 15 of the same filter tipped cigarette 14 in one of grooves 72, which is in co-axial alignment with one of grooves 63, by a first vacuum which may be different from the second vacuum exerted onto tobacco rod 16, the first vacuum in flow communication from a vacuum source (not shown) of vacuum apparatus 90 through vacuum source conduit 91, first vacuum regulator 92, first vacuum line 93, vacuum bore 42 and vacuum groove 44 of inner vacuum ring 40, vacuum conduit 68, and vacuum conduit 75 and groove aperture 74 of plate section 70. Then, by having the plate section 70 containing filter tipped cigarette 14 move longitudinally away from the tobacco rod 16, groove aperture 74 moves longitudinally along filter 15 away from the tobacco rod 16 end of cigarette 14. By setting the first vacuum, the movement of plate section 70 causes a preselected force to be exerted on filter 15 which tries to pull filter 15 away from tobacco rod 16. If filter 15 is not properly attached to tobacco rod 16, it will separate from it and the filter 15 and tobacco rod 16 will be identified and subsequently rejected. This purpose must be fulfilled while cigarettes 14 are proceeding through the production process. Therefore, the three rotational drums 20, 30, 80 of the present invention were developed.

Figure 3:
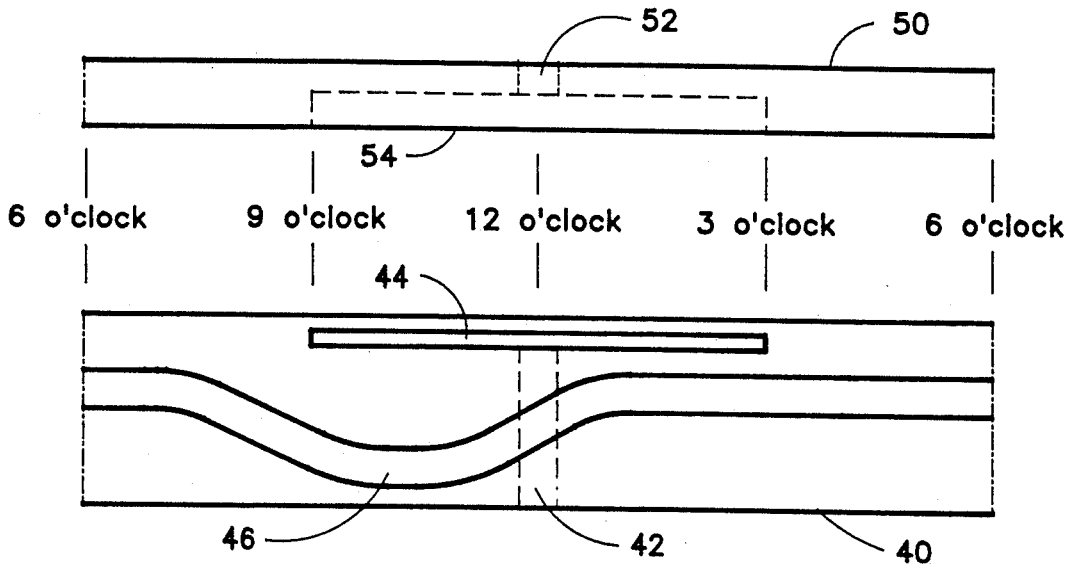
FIG. 3 is a two-dimensional view of the outer surface of the inner and outer vacuum rings laid flat of a transversely splitable rotatable drum of FIG. 1.
Figure 4A:
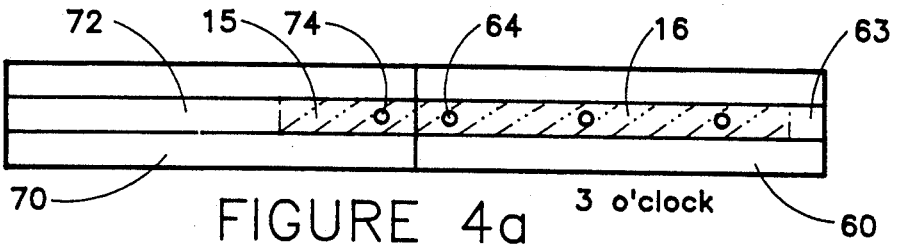
FIG. 4*a* is a view of a groove portion of a splitable drum at the 3 o'clock position shown in FIG. 3 depicting how a cigarette with an attached filter is placed on the drum.
Figure 4B:
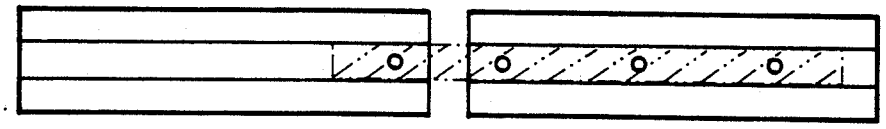
FIG. 4*b* is a view of a grooved portion of a splitable drum at the 12 o'clock position depicting how a cigarette with a filter responds to the drum splitting.
Figure 4C:
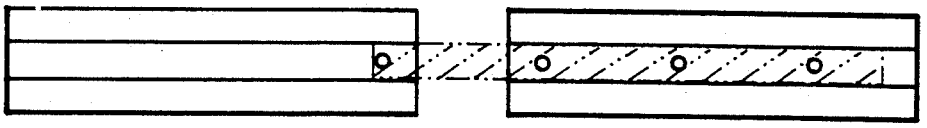
FIG. 4*c* is a view of a grooved portion of a splitable drum shown in the 10 o'clock position of FIG. 3 depicting how a cigarette properly attached filter responds to the drum splitting.
Figure 4D:
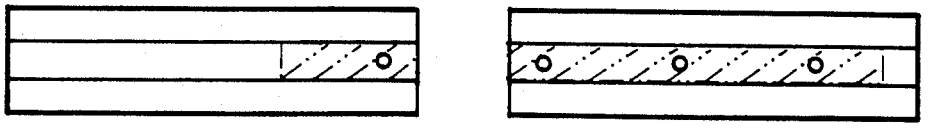
FIG. 4*d* is a view of a grooved portion of a splitable drum at the 10 o'clock position as shown in FIG. 3 depicting how a cigarette with an improperly attached filter would respond to the drum splitting.

With reference now to FIG. 1, transfer drum 20 receives a produced cigarette 14 into each groove 22 and holds cigarette 14 into groove 22 by means of a vacuum (not shown) exerted through apertures 26. As shown, the vacuum would start at about the 3 o'clock position of drum 20 and last through the shown clockwise rotation until drum 20 is to pass cigarette 14 to grooves 63/72 of drum assembly 30 at about drum 20's 9 o'clock position and drum assembly 30's 3 o'clock position. Drum assembly 30 exerts a second vacuum on the tobacco rod 16 portion of cigarette 14 through apertures 64 and a first vacuum on the filter 15 portion of cigarette 14 through aperture 74 from about its 3 o'clock position through its counter clockwise rotation until drum assembly 30 is to pass cigarette 14 to grooves 82 of reject drum 80 at about drum assembly 30's 9 o'clock position and drum 80's 3 o'clock position. As is seen in FIG. 3, the second vacuum on tobacco rod 16 is allowed by having a vacuum bore 52 into outer vacuum ring 50 at about its 12 o'clock position, the vacuum bore 52 being in flow communication with a vacuum groove 54 partway around outer vacuum ring 50 from about its 3 o'clock to 9 o'clock position. Likewise, the first vacuum on filter 15 is allowed by having a vacuum bore 42 into inner vacuum ring 40 at about its 12 o'clock position, the vacuum bore 42 being in flow communication with a vacuum groove 44 partway around inner vacuum ring 40 from about its 3 o'clock to 9 o'clock position. Further operation of drum assembly 30 will be hereinafter explained. Now, with reference back to FIG. 1, reject drum 80 receives either an entire filter cigarette 14 or a defective cigarette tobacco rod 16 into grooves 82 from grooves 63/72 of drum assembly 30. A vacuum (not shown) is provided through apertures 86 of grooves 82. As shown, the vacuum would start at about the 3 o'clock position of drum 80 and last through the shown clockwise rotation, until drum 80 is to pass cigarette 14 to a filter cigarette processing apparatus (not shown) at about drum 80's 9 o'clock position. Apertures 86 are shown positioned to have the vacuum exerted on the filter 15 of a nondefective cigarette 14. If cigarette 14 is defective, filter 15 will be pulled from tobacco rod 16. Defective filter 15 will not transfer because of the spaced relationship of a drum assembly 30 and drum 80. Because of this, apertures 86 will not hold tobacco rod 16 into grooves 82 and the tobacco rod 16 will fall from groove 82 and will not be passed to the next cigarette processing apparatus. With reference to FIGS. 4*a*–4*d*, FIG. 4*a* shows one of grooves 63/72 having received a cigarette at drum 30's 3 o'clock position. FIG. 4*b* shows that at drum 30's 12 o'clock position plate 70 has started to separate from ring 60. FIG. 4*c* shows how at the 10 o'clock position of drum 30 plate 70 has separated further from ring 60. FIG. 4*c* depicts a cigarette having a properly attached filter 15. Apertures 86 will grip filter 15 at the shown opening between plate 70 and ring 60. FIG. 4*d* show a cigarette where filter 15 and tobacco rod 16 have separated. As is shown, there is a void at the location where apertures 86 will pass so neither the filter nor tobacco rod should transfer to grooves 82 of reject drum 80.

Figure 8:
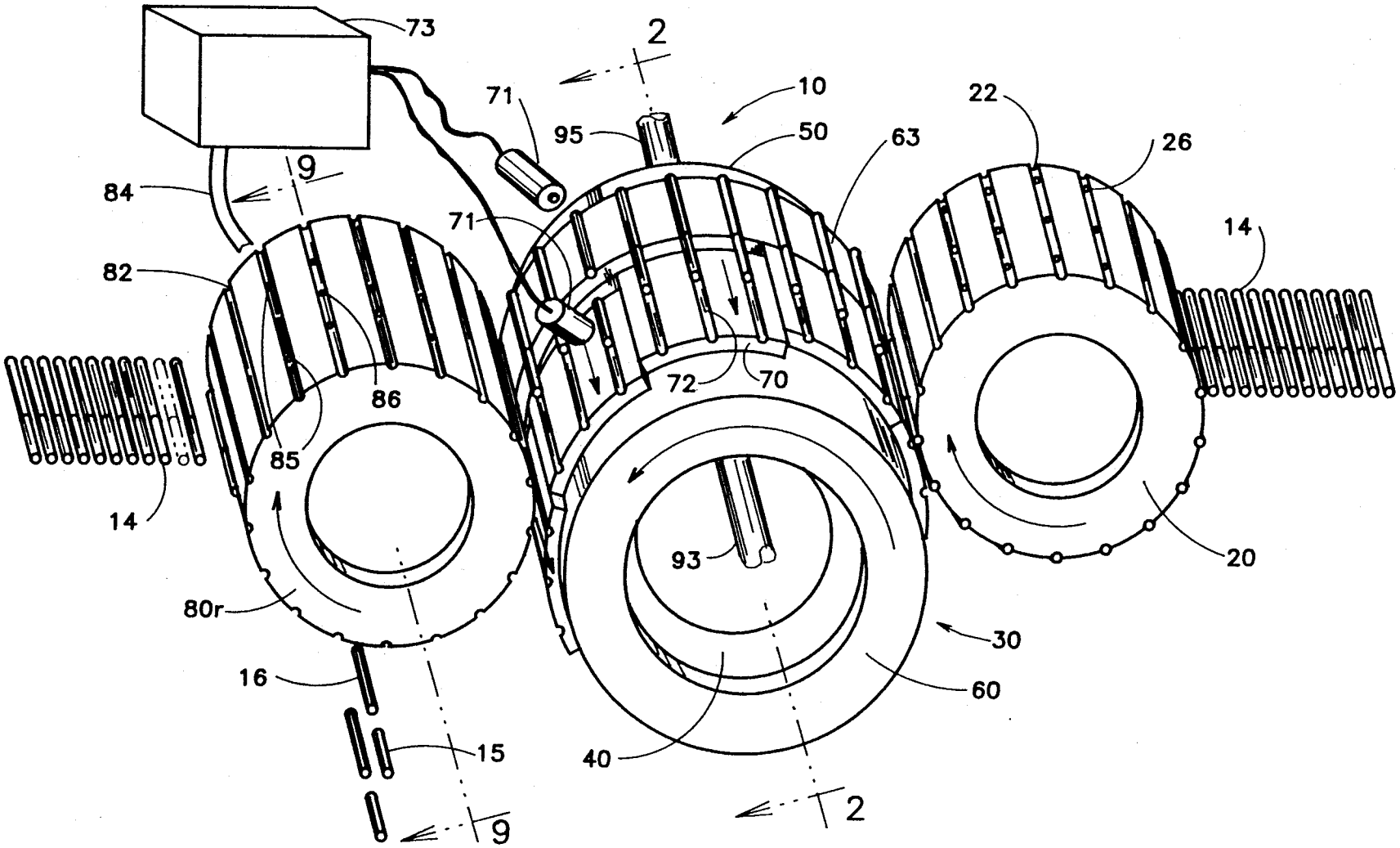
FIG. 8 is a perspective view of a preferred loose cigarette filter tip detecting station constructed in accordance with another embodiment of this invention.
Figure 9:
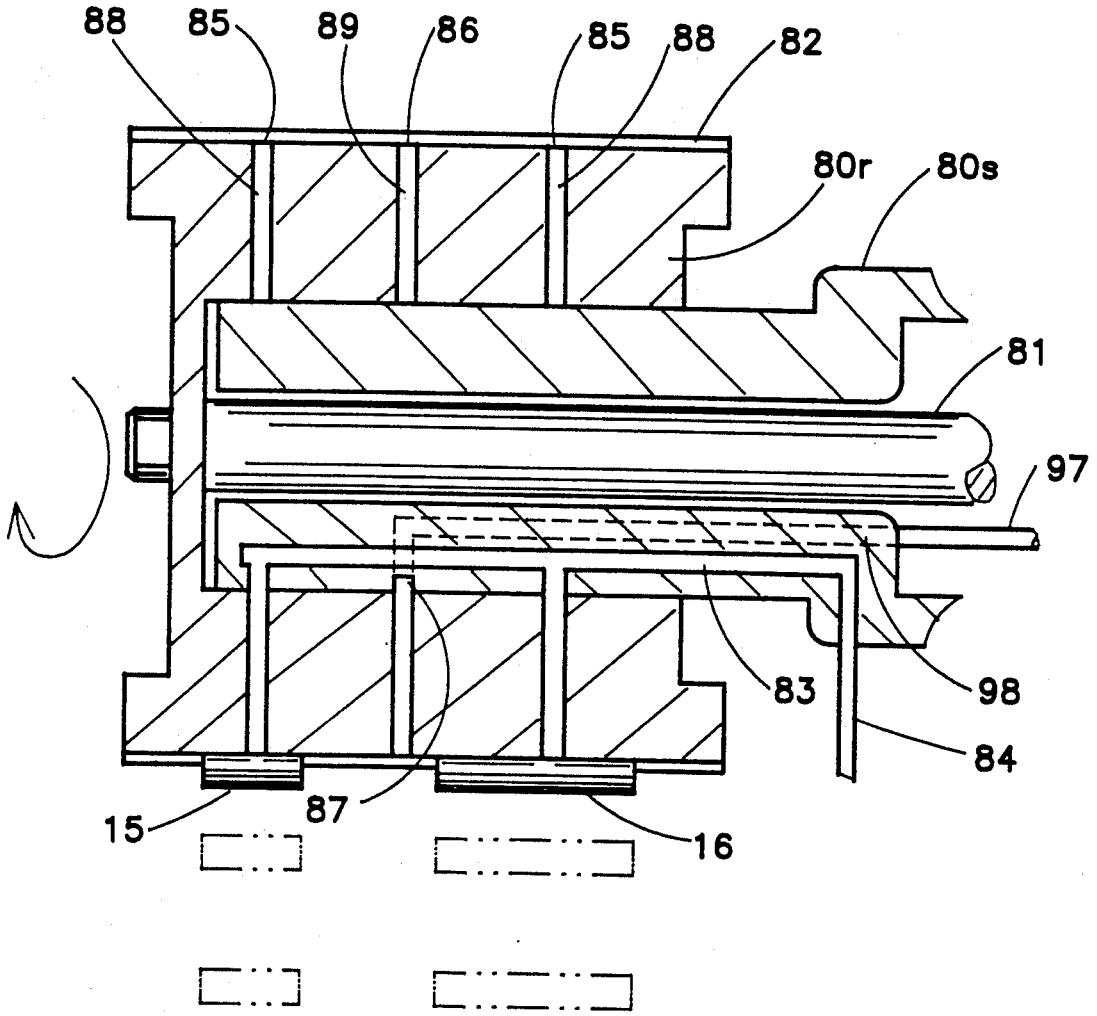
FIG. 9 is cross-section view of a reject drum of FIG. 8.

Alternatively, as will be discussed with FIGS. 8 and 9, sensors could be used to detect cigarette elements that have separated and an outward burst of air could be transmitted from other apertures 85 in grooves 82 of drum 80 to ensure that the defective cigarettes are rejected. Also, as will be explained hereinafter, a blow off assembly can be employed to ensure defective filters 15 o tobacco rods 16 do not remain in respective grooves 72 and 63.

With reference now to FIGS. 1, 2 and 3, the rotational operation of drum assembly 30 is further explained. Drum assembly 30 comprises a stationary inner vacuum ring 40, a stationary outer vacuum ring 50, a rotatable splittable ring 60, and a plurality of plate sections 70.

Inner vacuum ring 40 is cylindrically shaped with a vacuum end and a cam end, the outer cylindrical diameter of the vacuum end being greater than that of the cam end. Ring 40 allows communication of the first vacuum to filter 15 over the desired rotational portion of ring 60 by having a vacuum bore 42 in flow communication with a vacuum groove 44 partway around the outer surface of ring 40 toward the vacuum end. Inner vacuum ring 40 further controls the movement of the plurality of plate section 70 by having a cam groove 46 around the outer ring surface toward the cam end of ring 40. FIG. 3 depicts the outer cylindrical surface of ring 40 laid flat. The 6, 9, 12 and 3 o'clock positions relate to a clock face with drum 30 in the position as shown in FIG. 1. Cam groove 46 and vacuum groove 44 are also shown in a laid flat position.

Outer vacuum ring 50 allows communication of the second vacuum to tobacco rod 16 over the desired rotational portion of ring 60 by having a vacuum bore 52 in flow communication with a vacuum groove 54 partway around the surface of ring 50 which contacts ring 60. FIG. 3 depicts the outer cylinder surface of ring 50 laid flat, showing vacuum groove 54.

Rotatable splittable ring 60 has a cylindrical shape. Ring 60 has an interior core 61 which is connected to a shaft 62 which is used to rotate ring 60 around this cylindrical axis. A drive means (not shown) is connected to shaft 62 to provide rotation.

Ring 60 has a tobacco rod end receiving portion and a filter end receiving portion. The filter end receiving portion of ring 60 has an outer cylindrical diameter that is less than that of the tobacco rod end receiving portion in order to accommodate the plurality of plate sections 70. FIG. 1 shows eight plate sections 70. The outer diameter of the filter end receiving portion of ring 60 having plate sections 70 laying on the outer cylindrical surface, as will be later explained, will equal the outer cylindrical diameter of the tobacco rod end receiving portion of ring 60. The tobacco rod end receiving portion of ring 60 contains a plurality of grooves 63. FIG. 1 shows each plate section 70 having three grooves 63, which extend longitudinal to the axis of rotation of ring 60. Each of grooves 63 contains one or more apertures 64. Apertures 64 are in flow communication with vacuum conduits 65 which are internal to ring 60 and are also in flow communication with vacuum groove 54 in outer vacuum ring 50. Apertures 64 of each groove 63 communicate with the second vacuum to tobacco rods 16 of filter cigarettes 14 when the respective conduits 65 are in flow communication with vacuum groove 54 to hold tobacco rods 16 stationary in grooves 63.

At the filter end receiving portion of ring 60, ring 60 is hollowed sufficiently to fully surround inner vacuum ring 40, ring 60 thereby having an inner cylindrical diameter at the filter end just slightly greater then the outer cylindrical diameter of inner vacuum ring 40 at its vacuum end, so that the first vacuum exerted on filter 15 can be maintained.

Each one of the plurality of plate sections 70 has an inner and outer arcuately shaped surface, such that the inner surface will lay on ring 60 at its lesser outer cylindrical diameter portion toward its filter end. The plurality of plate sections 70 are juxtaposed to each other, thereby circumscribing ring 60 at its lesser outer cylindrical diameter portion toward its filter end.

Each plate section 70 has one or more grooves 72 embedded into its outer arcuately shaped surface. Grooves 72 are coaxially aligned with grooves 63 in ring 60. As an example, FIG. 1 shows each plate section 70 having three grooves 72. Each groove 72 contains one or more apertures 74. One or more apertures 74 of each groove 72 are in flow communication with a vacuum conduit 75. Each vacuum conduit 75 maintains flow communication with a vacuum conduit 68 through the filter rod end receiving portion of ring 60. Each vacuum conduit 68 is in flow communication with vacuum groove 44 of inner vacuum ring 40. Therefore, one or more apertures 74 of each groove 72 communicate with the first vacuum to filters 15 of filter cigarettes 14 when the respective conduit 68 is in flow communication with vacuum groove 44.

Each plate section 70 has a cam shaft 76 transversely connected to its inner arcuately shaped surface. Each cam shaft 76 has a cam 78 connected to it. The filter rod end receiving portion of ring 60 contains a cam bore 66 for each cam shaft 76, such that when each cam 78 is inserted into cam groove 46 of inner vacuum ring 40, the movement of each cam 78 in cam groove 46 will not be impeded. Each cam bore 66 is also shaped such that each plate section 70 is securely held against the filter rod end portion of ring 60.

Cam groove 46 of inner vacuum ring 40 is designed so that when a plate section 70 of splittable loose filter detecting drum assembly 30 is rotated past transfer drum 20 to obtain a filter cigarette 14 in one of grooves 72 and its corresponding groove 63 from a groove 22 of transfer drum 20, the plate section 70 coaxially abuts the large cylindrical diameter tobacco rod end receiving portion of ring 60. As ring 60 rotates toward reject drum 80, cam groove 46 causes the plate section to move axially away from the tobacco rod end receiving portion of ring 60. This causes the position of apertures 74 to move along filter 15 away from the tobacco rod 16. The first vacuum exerted on filter 15 through the moving apertures 74 causes a preset pulling force on filter 15 away from tobacco rod 16. If filter 15 is improperly connected to tobacco rod 16 they will separate. Cam groove 46 will cause the plate section 70 to move far enough so that an improperly connected filter 15 cannot be passed to a groove 82 of reject drum 80. After plate section 70 rotates past reject drum 80, cam groove 46 causes plate section 70 to again coaxially abut the tobacco rod end portion of ring 60 so the process can be repeated. FIG. 3 shows one path for a cam groove 46 which will permit the desired operation.

Figure 5:
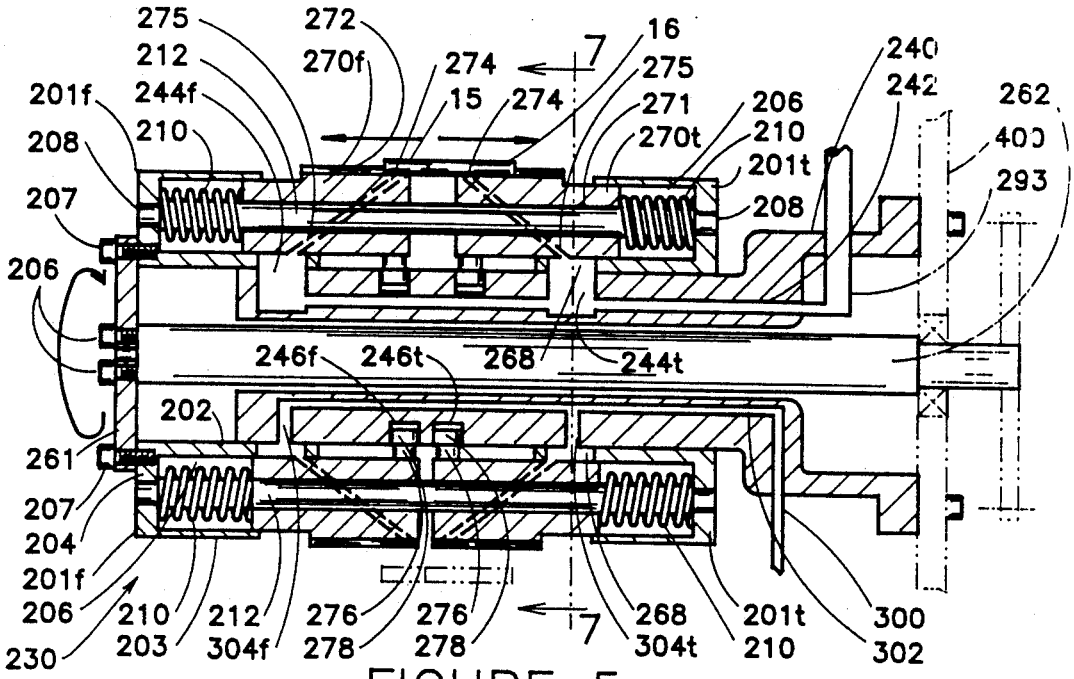
FIG. 5 is a cross-section view of an alternative transversely splitable rotatable drum to that shown in FIGS. 1 and 2 shown with selected portions cut away.
Figure 6:
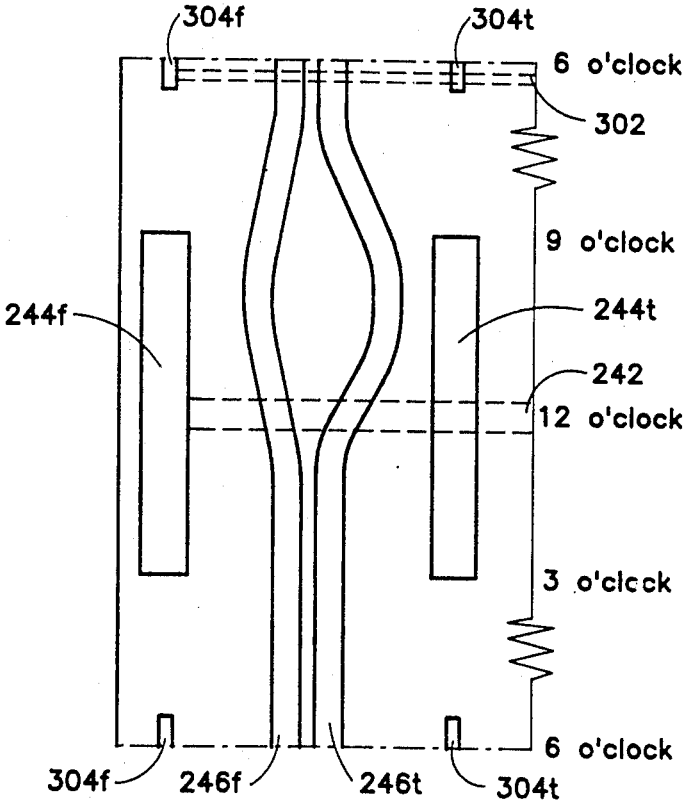
FIG. 6 is a view of a portion of the outer surface of the vacuum ring laid flat of a transversely splitable rotatable drum of FIG. 5 showing the vacuum, blow off, and cam grooves.
Figure 7:
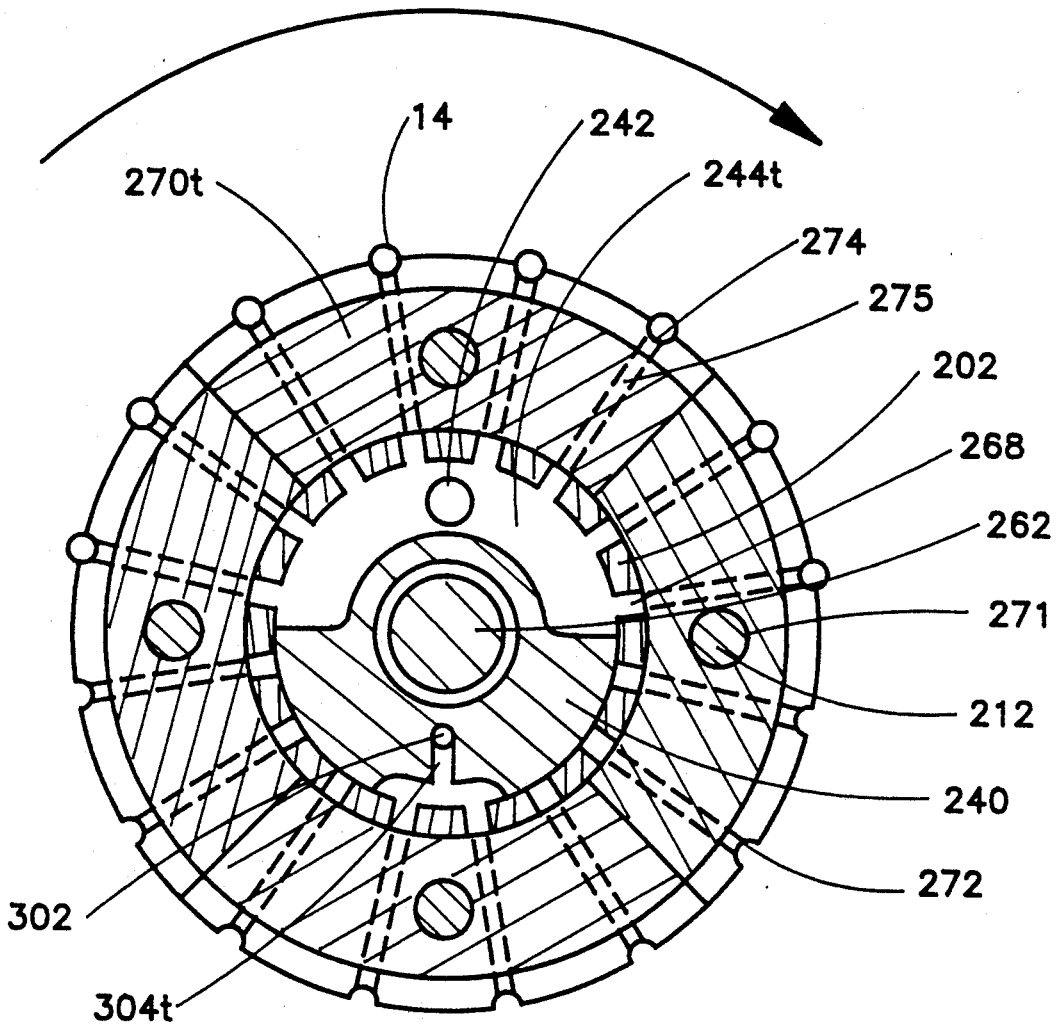
FIG. 7 is a cross-section view of the transversely splitable rotatable drum of FIG. 5 along the lines 7—7.

With reference now to FIGS. 5–7, there is shown an alternate embodiment for loose filter detecting drum assembly 30 of FIGS. 1–4. In FIGS. 5–7, different views of portions of a dual splitting loose filter section drum assembly 230 are shown. A numeral ending in "f" refers to a component related to filter 15, while a numeral ending in "t" relates to a component related to tobacco rod 16.

FIG. 5 shows a vacuum ring 240 connected to mounting plate 400, so that ring 240 is stationary. Shaft 262 passes through the center of ring 240. One end of shaft 262 is connected to a drive means (not shown) which rotates shaft 262 and thereby drum 230 in a counterclockwise direction, as shown by an arrow. Connected to and perpendicular to the other end of shaft 262 is a circular-shaped plate 261. For example, bolts 206 can be used to make this connection.

Circumferential channel members **201*f* and 201*t* have J-shaped cross-sections; wherein channel members 201*f* and 201*t* each have parallel legs 202 and 203, leg 202, the inner leg, being longer than leg 203. Legs 202 and 203 are joined by base 204 which is perpendicular thereto, thereby forming a channel identified by the numeral 206. The base 204 of channel members 201*f* is connected to plate 261, using, for example, bolts 207, such that channel 206 is open toward mounting plate 400**.

A plurality of guide rods 212 are connected to base 204 of channel member **201*f* at a guide rod connection, identified by the numeral 208. For example, guide rod connection 208 can be provided with a threaded end of guide rod 212 threaded into a threaded bore in base 204. For example, FIG. 7 shows four equally spaced guide rods 212. FIG. 5 shows that guide rods 212 are parallel to legs 202 and 203 of channel member 201*f* and shaft 262**.

A spring 210 is placed over each guide rod 212. A filter plate **270*f*, having a longitudinal bore 271 therethrough, and an opposed filter plate 270*t*, also having a longitudinal bore 271 therethrough are next placed on each guide rod 212 using bores 271. Plates 270*f* and 270*t* are arc-shaped and partway slideable into channels 206. FIG. 7 shows four plates 207*t***.

A spring 210 is placed over each guide rod 212 having another spring 210 and plates **270*f* and 270*t* also inserted thereon. The base 204 of circumferential channel member 201*t* is next connected to each guide rod 212 at guide rod connection 208, such that channel 206 of channel members 201*t* faces channel 206 of channel member 201*f***.

Each of plates **270*f* and 270*t* have a cam shaft 276 connected to their underneath arc-shaped surface. A cam 278 is connected to each shaft 276. As seen in FIGS. 5 and 6, vacuum ring 240 has a pair of cam grooves 246*f* and 246*t* circumscribing its outer surface. Cam groove 246*f* receives cam 278 for each plate 270*f* and cam groove 246*t* receives cam 278 for each plate 240*t*. A vacuum ring 240 is stationary, the rotation of shaft 262 causes plates 270*f* and 270*t* to rotate and their respective cams 278 follow the grooves 246*f* and 246*t*. As shown, at the 3 o'clock position of drum assembly 230, plates 270*f* and 270*t* are at their closest. As they rotate toward 12 o'clock, plates 270*f* and 270*t* start to split longitudinally. After passing 9 o'clock, plates 270*f* and 270*t* return to their closest position. The upper portion of FIG. 5 shows the 12 o'clock position and the bottom portion shows the 6 o'clock position of drum assembly 230**.

Each of plate sections **270*f* and 270*t* have a plurality of grooves 272 on their outer arc-shaped surface parallel to shaft 262, each groove 272 in a plate section 270*f* being in axial alignment with a corresponding groove 272 in an opposed plate section 270*t*. FIG. 7 shows, for example, each plate section 270*t* having four grooves 272** therein.

A cigarette will be received by each groove 272 and will be held for a time in the groove 272 by a vacuum. A vacuum is to be exerted on both the filter 15 and tobacco rod 16. If different vacuum pressure is desired to be exerted on filter 15 and rod 16, either two vacuum sources or one vacuum source with different geometry of vacuum supply lines can be utilized. As shown in the Figures, one vacuum line 293 is used being connected to a vacuum regulator and vacuum apparatus (neither shown).

Vacuum ring 240 has vacuum grooves **244*f* and 244*t* partway around its outer surface. FIG. 6 shows grooves 244*f* and 244*t* are from about the 9 o'clock to 3 o'clock positions of ring 240. A vacuum bore 242 in ring 240 provides vacuum connectivity between vacuum line 293, groove 244*t*, and groove 244*f*. Each groove 272 has a groove aperture 274 which is the opening of a conduit 275 from groove 274 to the inner arc-shaped surface of respective plate 270*f* or 270*t*. Respective leg 202 of channel member 201*f* or 201*t* has a conduit 268 for each conduit 275 which maintains continuous flow communication therewith. Conduits 268 provide vacuum flow communication from the respective vacuum grooves 244*f* or 244*t* to filter 15 or tobacco rod 16**.

In operation, axially aligned grooves 272 will receive a cigarette 14 from a transfer drum as grooves 272 pass approximately drum assembly 230's 3 o'clock position.

A vacuum is exerted through groove aperture 274 in plate 270*f* onto filter 15 and a vacuum is exerted through groove aperture 274 in plate 270*t* onto tobacco rod 16. As the drum assembly 230 rotates counterclockwise, the plates 270*f* and 270*t* separate further apart longitudinally causing an opposed pulling action on filter 15 and tobacco rod 16. Improperly joined filters 15 and tobacco rods 16 will separate, while properly joined units will not separate. Properly joined cigarettes 14 will transfer to reject drum 80 because of the alignment of apertures 86 in grooves 82, as previously explained with the embodiment of FIG. 1–4. Improperly joined units will not transfer.

To ensure that grooves 272 do not retain filters 15 or 25, tobacco rods 16 of improperly joined cigarettes, vacuum ring 240 has blow off grooves 304*f* and 304*t* into its outer surface at approximately the 6 o'clock position of drum assembly 230. A blow off line 300 is connected to an air source (not shown). A blow off bore 302 in vacuum ring 240 provides flow communication between blow off line 300, blow off groove 304*t*, and blow off groove 304*f*. Grooves 304*t* and 304*f* are positioned so that they provide blow off air through conduits 268 and 275 and out respective apertures 274 as they pass the approximate 6 o'clock position of drum assembly 230, to ensure that any cigarette components which did not transfer to reject drum 80 as grooves passed approximately the 9 o'clock position of drum assembly will be expelled from grooves 272 before grooves 272 rotate back to the 3 o'clock position of drum assembly 230 to pick up another cigarette 14 from transfer drum 20. With reference to FIGS. 8 and 9, apparatus 10 is shown having sensors or detectors 71 which detect whether or not each filter cigarette 14 is defective in the attachment of filter 15 to tobacco rod 16. Any number of types of sensors can be used. For example, as shown sensors 71 are positioned to detect the physical location of passing cigarettes 14. Those skilled in the art can see other ways to detect faulty cigarettes, such as using one light omitting unit which will direct a light beam at the filter 15/tobacco rod 16 union and detect a fault if light passes therethrough.

Sensors 71 are connected to controller 73. Controller 73 is programmed to remember which cigarettes 14 are defective. To ensure that defective cigarettes are not passed on through further cigarette processing and packaging stations, controller controls a blow off system in reject drum 80 to cause an air force to be expelled from apertures 85 when the remembered defective cigarettes rotate past a reject point, shown as being at the 6 o'clock position.

As shown, reject drum 80 rotates in a clockwise direction, opposite that of drum assembly 30. A vacuum force is provided through at least one aperture 86 in each groove 82 of reject drum 80 from about the 3 o'clock position passing through the 6 o'clock position and to approximately the 9 o'clock position, where the vacuum force ceases and the non-defective cigarettes are passed on to a filter cigarette processing apparatus (not shown). Reject drum 80 has a stationary portion 80*s* and a rotatable portion 80*r*. Shaft 81 is connected at one end to a drive means (not shown) and at the other end to rotatable portion 80*r*. Vacuum line 97 from a vacuum source (not shown) is connected to a vacuum bore 98 in stationary portion 80*s*. Vacuum bore 98 is in vacuum communications with vacuum groove 87 which passes around the outer portion of stationary portion 80*s* from about the 3 o'clock to 6 o'clock to 9 o'clock positions, similar to groove 44 shown in FIG. 3. The vacuum force is provided through vacuum bore 89 and then through aperture 86 in rotatable portion 80*r* when respective bores 89 are in vacuum communication with groove 87.

Reject drum 80 is shown having a reject point at approximately the 6 o'clock position, similar to that shown for blow off grooves 304*f* and 304*t* in FIGS. 5–7. If any portion of a defective cigarette is passed from drum assembly 30 to reject drum 80, controller 73 ensures that the defective filter 15 or tobacco rod 16 does not pass further. At the instant in time when a remembered defective cigarette is possibly passing the reject point, controller 73 causes an air force to be expelled through blow off line 84, through blow off bore 83 in stationary portion 80*s*, through blow off bore 88 in rotatable portion 80*r* and out through apertures 85, positioned in groove 82 at a physical location where a filter 15 or a tobacco rod 16 would be located. The air force exerted is sufficient to overcome the vacuum force to blow off the defective cigarette components from reject drum 80.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A loose filter tip detection and elimination machine, comprising:

a) means providing a first and a second vacuum force;

b) a rotatable transversely splitable drum assembly segments, said drum assembly having longitudinally extending grooves therein, continuously extending onto both said first and second segments, each groove being sized to receive a filter tip cigarette, each groove being in vacuum communication with said means providing said first and second vacuum forces, said first vacuum force being in vacuum communication with said first segment, and said second vacuum force being in vacuum communication with said second segment, said first segment of said drum being coupled with a tobacco rod end of said filter tip cigarette by said first vacuum force and said second segment of said drum being coupled with a filter of said filter tip cigarette by said second vacuum force;

c) means to transfer filter tip cigarettes each having a filter and a tobacco rod end, to said grooves in said rotatable drum assembly; and, d) means to remove said tobacco rod end and said filter thereof from said rotatable drum assembly.

2. The apparatus of claim 1, wherein each groove of said first segment will receive said filter end of one said filter tip cigarette and said corresponding groove in said second segment will receive said tobacco rod end of said cigarette.

3. The apparatus of claim 1, wherein said rotatable transversely splitable drum assembly includes cam means to separate said first and said second segments during rotation of said drum assembly.

4. The apparatus of claim 1, wherein said means to remove said cigarettes and pieces thereof from said rotatable drum assembly includes means to remove and separate detached filters and tobacco rod sections from filter tip cigarettes.

5. The apparatus of claim 1, wherein said first vacuum force is at a preselected vacuum which is lesser than said second vacuum force.

6. The apparatus of claim 1, wherein said first and said second segments are at a closest position when said means to transfer filter tip cigarettes transfers a cigarette to one of said grooves in said drum and wherein as said drum rotates toward said means to remove said cigarettes and pieces thereof, said first and second segments separate, thereby exerting a pulling force on said cigarette to see if said filter end will separate from said tobacco rod end.

7. The apparatus of claim 6, said means to remove said cigarettes and pieces thereof from said rotatable drum assembly further comprising:

a reject drum having longitudinally extending grooves therein; said grooves having at least one aperture therein; said at least one aperture being in vacuum communication with a means creating a third vacuum force; said rotatable transversely splitable drum assembly and said reject drum rotating in opposite directions; each of said grooves in said rotatable transversely splitable drum assembly being in coaxial alignment with one of said grooves in said reject drum as said drums rotate past each other; and, said at least one aperture being aligned such that if said pulling force separates said filter end and said tobacco rod end thereby creating a gap, said at least one aperture will be adjacent to said gap, but if said pulling force does not separate said filter end and said tobacco rod end, said at least one aperture will cause said third vacuum force to be exerted on said cigarette thereby transferring said cigarette from said rotatable transversely splitable drum assembly to said reject drum.

8. The apparatus of claim 6, wherein only one of said first or second segments of said rotatable transversely splitable drum assembly moves longitudinally to cause said first and second segments to separate.

9. The apparatus of claim 6, wherein both said first and second segments of said rotatable transversely splitable drum assembly move longitudinally away from each other to cause said first and second segments to separate.

10. The apparatus of claim 3, wherein:

a) said first segment of said rotatable transversely splitable drum assembly includes: a plurality of juxtaposed arc-shaped plate sections, said plurality of juxtaposed plate sections having a cylindrical-shape, each arc-shaped plate section having an inner and an outer surface, said outer surface containing at least one of said longitudinally extending grooves;

b) said cam means to separate said first and said second segments during rotation of said drum assembly includes: an inner vacuum ring having a cam groove therein, said cam groove fully circumscribing said inner vacuum ring; a plurality of cam shafts each having two ends, one end of each of said cam shafts connected to a cam, the other end of each of said cam shafts connected to said inner surface of one of said plurality of juxtaposed arc-shaped plate sections and perpendicular thereto; and c) said second segment of said rotatable transversely splitable drum assembly includes: a cylinder-shaped drum being hollow at least one end and having an axis, said hollow end of said drum encircling said inner vacuum ring and in coaxial alignment therewith; means to axially rotate said drum; said drum toward said hollow end having a plurality of cam bores therethrough, each cam bore receiving one of said plurality of cam shafts such that said inner surface of said arc-shaped plate section to which said cam shaft is connected is adjacent an outside surface of said drum and said cam to which said cam shaft is connected engages said cam groove in said inner vacuum ring, said cam bore being sized to permit said cam to follow said cam groove fully circumscribing said inner vacuum ring without being impeded; said drum further containing one of said longitudinally extending grooves for each of said grooves in said plurality of juxtaposed arc-shaped plate sections, each of said grooves in said drum being axially aligned with one of said grooves in said plate sections.

11. The apparatus of claim 10, wherein said means to axially rotate said drum includes:

an interior core for said drum, a shaft connected to said core aligned with said axis of said drum, and a means to rotate said shaft.

12. The apparatus of claim 10, wherein:

said vacuum communication between said means providing a first vacuum force and each said groove in one of said plate sections of said first segment is provided during a period of rotation of said splitable drum assembly when each said groove is perpendicularly disposed over a vacuum groove partway circumscribing said inner vacuum ring by having said means providing a first vacuum force communicating with a vacuum bore in said inner vacuum ring, said vacuum bore further communicating with said vacuum groove partway circumscribing said inner vacuum ring, said vacuum groove further communicating with a vacuum conduit for each said groove through said hollow end of said drum encircling said inner vacuum ring, each said vacuum conduit further communicating with a vacuum conduit for each said groove through said plate section containing each said groove, said plate section vacuum conduit terminating in at least one groove aperture in each said groove.

13. The apparatus of claim 10, wherein: said vacuum communication between said means providing a second vacuum force and each said groove in said cylinder-shaped drum of said second segment during a period of rotation of said splitable drum assembly when each said groove is in a longitudinal alignment with a vacuum groove inscribed into a side of an outer vacuum ring abutting said cylinder-shaped drum and partway thereround by having said means providing a second vacuum force communicating with a vacuum bore in said outer vacuum ring, said vacuum bore further communicating with said vacuum groove inscribed into said side of said outer vacuum ring, said vacuum groove further communicating with a vacuum conduit for each groove in said cylinder-shaped drum of said second segment, each said vacuum conduit terminating in at least one groove aperture in each said groove.

14. The apparatus of claim 10, wherein said cam groove causes said cam connected to each of said arc-shaped plate section to move each of said plate sections having said longitudinal grooves therein to a closest position axially to said axially aligned grooves in said cylinder-shaped drum at a location where said means to transfer filter tip cigarettes transfers a cigarette to one of said grooves and further wherein as said transversely splitable drum assembly rotates toward said means to remove said cigarettes end pieces thereof, said cam groove causes said cam to axially move said groove in said plate section away from said groove in said cylinder-shaped drum.

15. The apparatus of claim 3, wherein:

a) said cam means to separate said first and said second segments during rotation of said drum assembly includes: an inner vacuum ring having a first and a second cam groove therein and an outer surface, each of said cam grooves fully circumscribing said inner vacuum ring; and, a plurality of cam shafts each having a first and second end, said first end of each of said cam shafts connected to a cam;

b) said first segment of said rotatable transversely splitable drum assembly includes: a first circumferential channel having parallel circumferential inner and outer legs and a base, each leg and base having two ends, said base being perpendicular to said legs and each end of said base being connected to one end of each of said legs, said inner leg having a length greater than said outer leg, said inner and outer legs being coaxially aligned, wherein said legs and base form said first circumferential channel with a first opening therein; a plurality of first juxtaposed arc-shaped plate sections, said first plurality of juxtaposed plate sections having a cylindrical-shape, each plate section having a first and second end and an inner and outer surface, each of said first plate sections being partway slidable into said first circumferential channel at said first end, said outer surface containing at least one of said longitudinally extending grooves extending from said second end toward said first end; means to guide said plurality of first juxtaposed arc-shaped plate sections; each of said first plate sections having said second end of one of said cam shafts connected to said inner surface and perpendicular thereto such that said cam connected to said cam shaft engages said first cam groove in said inner vacuum ring; and means to axially rotate said first circumferential channel; and, c) said second segment of said rotatable transversely splitable drum assembly includes: a second circumferential channel having parallel circumferential inner and outer legs and a base, each leg and base having two ends, said base being perpendicular to said legs and each end of said base being connected to one end of each of said legs, said inner leg having a length greater than said outer leg, said inner and outer legs being co-axially aligned, wherein said legs and base form said second circumferential channel with a second opening therein; a plurality of second juxtaposed arc-shaped plate sections, said second plurality of juxtaposed plate sections having a cylindrical-shape, each plate section having a first and second end and an inner and outer surface, each of said second plate sections being partway slidable into said second circumferential channel at said first end, said outer surface containing at least one of said longitudinally extending grooves extending from said second end toward said first end, said second ends of said first and said second plate sections being adjacent, each of said grooves in said outer surface of said second plate sections being axially aligned with one of said grooves in said outer surface of said first plate sections; wherein said first and said second openings face each other, and said means to guide said plurality of first juxtaposed arc-shaped plate sections also guides said plurality of second juxtaposed arc-shaped plate sections, thereby causing said means to axially rotate said first circumferential channel to also axially rotate said circumferential channel therewith; each of said second plate sections having said second end of one of said cam shafts connected to said inner surface and perpendicular thereto such that said cam connected to said cam shaft engages said second cam groove in said inner vacuum ring.

16. The apparatus of claim 15, wherein said first and said second cam grooves cause said cams connected to each of said first and said second plate sections to move each of said adjacent first and second plate sections having said axially aligned longitudinal grooves therein to a closest position axially at a location where said means to transfer filter tip cigarettes transfers a cigarette to one of said axially aligned longitudinal grooves and further wherein as said transversely splitable drum assembly rotates toward said means to remove said cigarettes and pieces thereof, said first and second cam grooves cause said axially aligned longitudinal grooves in said adjacent first and second plate sections to move axially apart.

17. The apparatus of claim 15, wherein said means to axially rotate said first circumferential channel includes, a drive means; a shaft having a first and second end, said first end connected to said drive means, said shaft coaxially aligned with said inner vacuum ring and passing therethrough; and, a plate connected to said second end of said shaft, said plate further connected to said base of said first circumferential channel.

18. The apparatus of claim 15, wherein said means to guide said plurality of first juxtaposed arc-shaped plate sections includes: a plurality of guide rods, each guide rod having a first and second end; said first end of each guide rod being attached to a first guide rod connection in said base of said first circumferential channel, said guide rod next having a first spring inserted thereover, said guide rod next passing through a longitudinal bore through one of said first plate sections, said guide rod next passing through a longitudinal bore through one of said second plate sections, said guide rod next having a second spring inserted thereover, said second end of said guide rod being attached to a second guide rod connection in said base of said second circumferential channel; and, wherein each of said guide rods is parallel to said shaft.

19. The apparatus of claim 15, wherein:

said vacuum communication between said means providing a first vacuum force and each said groove in one of said first plate sections of said first segment and between said means providing a second vacuum force and each said groove in one of said second plate sections of said second segment is provided during a period of rotation of said splitable drum assembly when each said groove in said first segment is perpendicularly disposed over a first vacuum groove and said axially aligned groove in said second segment is perpendicularly disposed over a second vacuum groove, both of said first and second vacuum grooves partway circumscribing said inner vacuum ring by having a vacuum source providing a vacuum connected to a vacuum line, said vacuum line communicating with a vacuum bore in said inner vacuum ring, said vacuum bore further communicating with said second vacuum groove and said first vacuum groove in said inner vacuum ring; said first vacuum force being provided by having said first vacuum groove further communicating with a vacuum conduit for each said groove in said first segment, each said vacuum conduit passing through said inner leg of said first circumferential channel, each said vacuum conduit further communicating with a vacuum conduit for each said groove through said first plate section containing each said groove, said plate section vacuum conduit terminating in at least one groove aperture in each said groove; and, said second vacuum being provided by having said second vacuum groove further communicating with a vacuum conduit for each said groove in said second segment, each said vacuum conduit passing through said inner leg of said second circumferential channel, each said vacuum conduit further communicating with a vacuum conduit for each said groove through said second plate section containing each said groove, said plate section vacuum conduit terminating in at least one groove aperture in each said groove.

20. The apparatus of claim 1, wherein said rotatable transversely splitable drum assembly further includes means to blow off cigarettes and pieces thereof after said rotatable drum assembly has rotated past said means to remove said cigarettes and pieces thereof.

21. The apparatus of claim 15, wherein said rotatable transversely splitable drum assembly further includes means to blow off cigarettes and pieces thereof after said rotatable drum assembly has rotated past said means to remove said cigarettes and pieces thereof.

22. The apparatus of claim 21, wherein said blow off means is provided by a blow off source providing air, said blow off source communicating with a blow off line, said blow off line communicating with a blow off bore in said inner vacuum ring, said blow off bore communicating with first and second blow off groove in said outer surface of said inner vacuum ring, said first blow off groove being positioned to communicate with each said vacuum conduit through said inner leg of said first circumferential channel, and said second blow off groove being positioned to communicate with each said vacuum conduit through said inner leg of said second circumferential channel.

23. The apparatus of claim 1, further comprising means to detect faulty cigarettes, means providing an air force, and means to control said means providing an air force.

24. The apparatus of claim 23, wherein said means to detect faulty cigarettes includes at least one detector located at a position to detect any separation of said filter tip cigarette received in said longitudinally extending grooves in said rotatable transversely splittable drum assembly and transmit to said means to control said means providing an air force a signal if said cigarette is faulty, wherein said means to control said means providing an air force remembers which of said cigarettes is faulty; and, wherein said means to control said means providing an air force ensures that said means providing an air force is in air flow communication with said means to remove said cigarettes and pieces thereof from said rotatable drum assembly at a time when said faulty cigarette is at a blow off location on said means to remove said cigarettes and pieces thereof.

25. The apparatus of claim 24, wherein said means to remove said cigarettes and pieces thereof from said rotatable drum assembly includes: a reject drum having longitudinally extending grooves therein; said grooves having at least one vacuum aperture and at least two air apertures therein; said at least one vacuum aperture being in vacuum communication with a means creating a third vacuum force; said rotatable transversely splitable drum assembly and said reject drum rotating in opposite directions; each of said grooves in said rotatable transversely splitable drum assembly being in coaxial alignment with one of said grooves in said reject drum as said drums rotate past each other; said at least one vacuum aperture causing said third vacuum force to be exerted on said cigarette thereby transferring said cigarette from said rotatable transversely splitable drum assembly to said reject drum; and wherein said means to control said means providing an air force ensures that said means providing an air force is in air flow communication with said at least two air apertures to remove said faulty cigarettes from said reject drum.

26. A method for determining whether the filter and tobacco rod of a filter tip cigarette are properly connected, comprising the steps of:

a) receiving a filter tip cigarette having a filter rod and tobacco rod from a filter tip cigarette manufacturing station;

b) applying a first vacuum to said filter rod and a second vacuum to said tobacco rod;

c) exerting a preselected pulling force to see if said filter rod will separate from said tobacco rod; and, d) rejecting said filter tip cigarette if said pulling force causes said filter to separate from said tobacco rod or transferring said filter tip cigarette to a station for further processing if said pulling force does not cause said filter to separate from said tobacco rod.

27. The method of claim 26, wherein said step of exerting a pulling force to see if said filter rod will separate from said tobacco rod is accomplished by:

causing a pulling force on said filter away from said tobacco rod by moving said first vacuum along said filter away from said tobacco rod.

28. The method of claim 26, wherein said step of exerting, a pulling force to see if said filter rod will separate from said tobacco rod is accomplished by:

causing opposing pulling forces on said filter rod and said tobacco rod by simultaneously moving said first vacuum along said filter rod and moving said second vacuum along said tobacco rod.

* * * * *

UNITED STATES PATENT AND TRADEMARK OFFICE

CERTIFICATE OF CORRECTION

PATENT NO. : 5,232,100
DATED : August 3, 1993
INVENTOR(S) : Robert T. Lewis

It is certified that error appears in the above-indentified patent and that said Letters Patent is hereby corrected as shown below:

In column 9, lines 14 and 15, delete "or 25";

In column 9, line 27, after "grooves" add --272--;

In cloumn 9, line 29, after "assembly" add --230--;

In column 9, line 47, after "controller" add --73--;

In column 9, line 58, after "cigarettes" add --14--;

In column 9, line 66, change "communications" to --communication--;

In column 10, line 34, Claim 1, after "segments" add --being rotatably splitably into first and second segments--.

Signed and Sealed this
Fifth Day of April, 1994

Bruce Lehman

*Attest:*

BRUCE LEHMAN

*Attesting Officer*

*Commissioner of Patents and Trademarks*